US005372122A

United States Patent [19]

Hong et al.

[11] Patent Number: 5,372,122

[45] Date of Patent: Dec. 13, 1994

[54] WIND GUIDING DISK OF KITCHEN SMOKE EXHAUSTER

[76] Inventors: Tsun-Seng Hong, 408-6, Sec.2, Fong-Sing Rd., Tan-Dzu; Sun-Sing Jang, 650, Yuan-Huan E. Rd., Fong-Yuan, both of, Taichung, Taiwan, Prov. of China

[21] Appl. No.: 137,475

[22] Filed: Oct. 18, 1993

[51] Int. Cl.[5] ..... F24C 15/20

[52] U.S. Cl. ..... 126/299 R; 126/299 D

[58] Field of Search ..... 126/299 R, 299 D

[56] References Cited

U.S. PATENT DOCUMENTS 5,230,327 7/1993 Jang et al. ..... 126/299 D

*Primary Examiner*—Carroll B. Dority

*Attorney, Agent, or Firm*—Browdy and Neimark

[57] ABSTRACT

A wind guiding disk of a kitchen smoke exhauster comprises a first element and a second element. The first and the second elements are made of heat-resisting material by injection molding. The first element has a first bottom flat collar provided with a first inner upright collar and a first outer upright collar which is provided with an opening and a wind guiding tube portion for being fastened to a bottom plate of the kitchen smoke exhauster. The second element has a second bottom flat collar provided with a second inner upright collar and a second outer upright collar. The second element is fitted into the second element such that the bottom of the second bottom flat collar is located on the top of the stopping collar of the first element, and that a passage is formed between the first inner upright collar and the second inner upright collar.

6 Claims, 10 Drawing Sheets

WIND GUIDING DISK OF KITCHEN SMOKE EXHAUSTER

BACKGROUND OF THE INVENTION

The present invention relates to kitchen smoke exhauster, and particularly to a wind guiding disk of kitchen smoke exhauster.

A kitchen smoke exhauster is an indispensable kitchen appliance in a modern home and is used to exhaust the cooking fume so as to keep the kitchen free from the deposit of the cooking oil vapor. However, the conventional kitchen smoke exhausters available in the market today are often limited in that they can not exhaust the cooking fume effectively. In other words, the conventional kitchen smoke exhausters are not provided with an adequate suction effect.

SUMMARY OF THE INVENTION

It is therefore the primary objective of the present invention to provide a kitchen smoke exhauster with a wind guiding member capable of enhancing the suction efficiency of the kitchen smoke exhauster.

The foregoing objective and structure of the present invention can be more readily understood by studying the following detailed description of the present invention in conjunction with the drawings provided herewith.

DETAILED DESCRIPTION OF THE INVENTION

Figure 1:
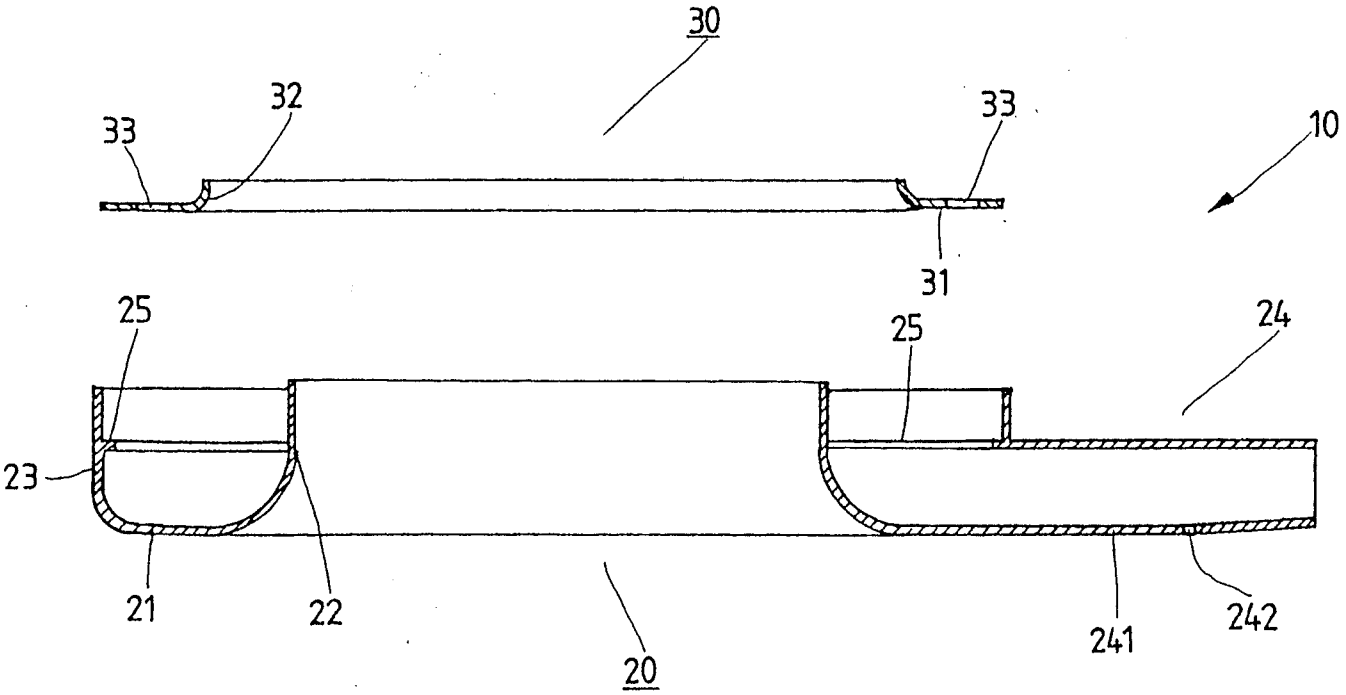
FIG. 1 shows an exploded schematic view of a wind guiding disk of the present invention.
Figure 2:
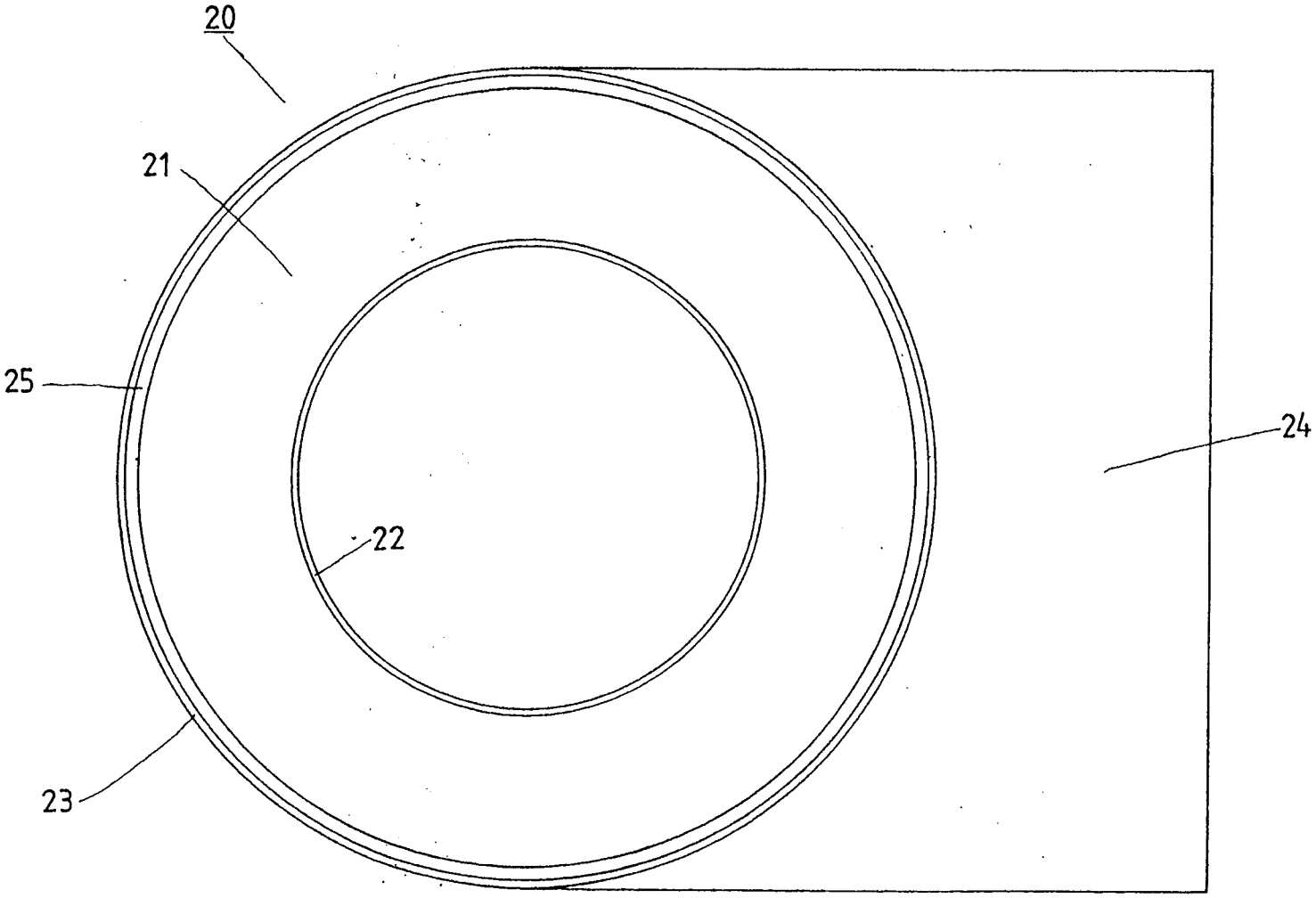
FIG. 2 shows a top plan view of a first element as shown in FIG. 1.
Figure 3:
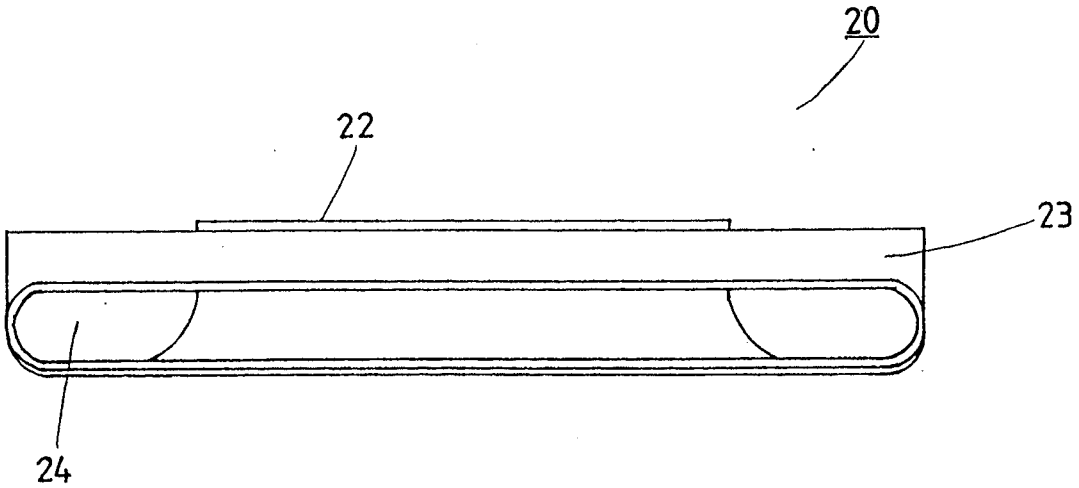
FIG. 3 shows a right elevational view of the first element as shown in FIG. 1.
Figure 4:
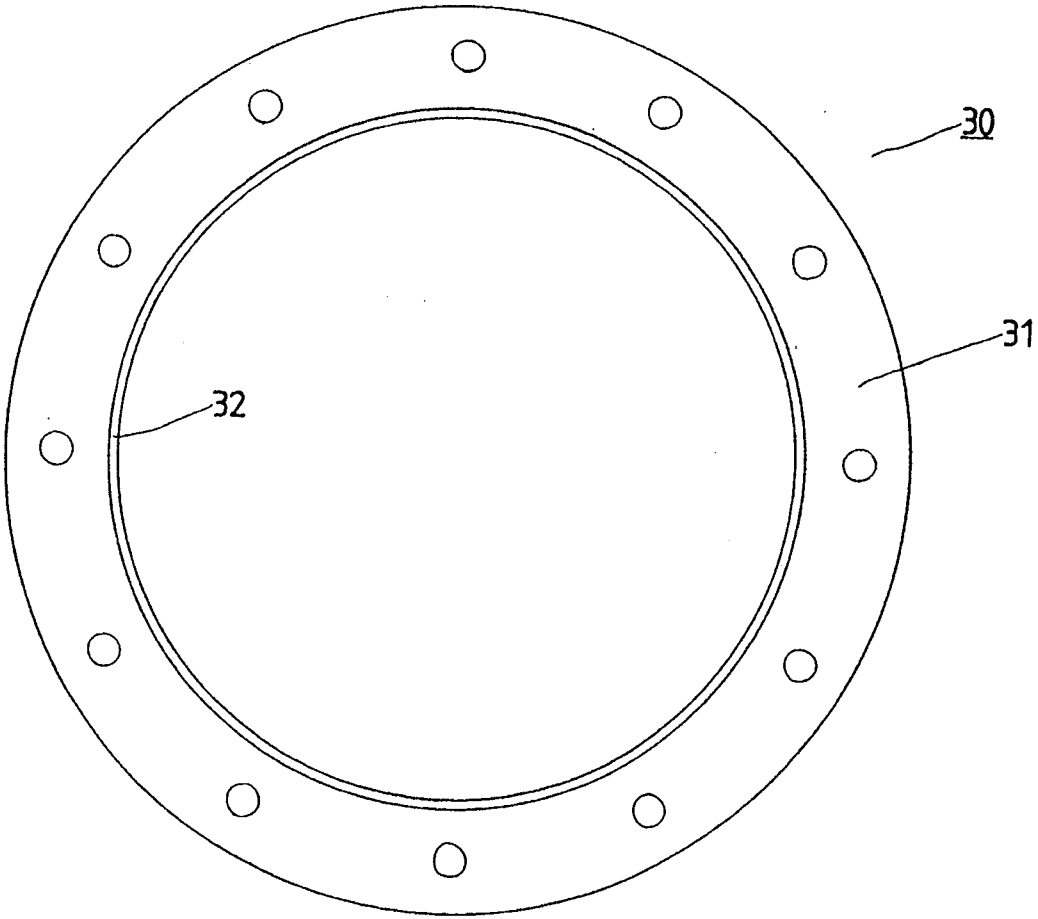
FIG. 4 shows a top plan view of a second element as shown in FIG. 1.
Figure 5:
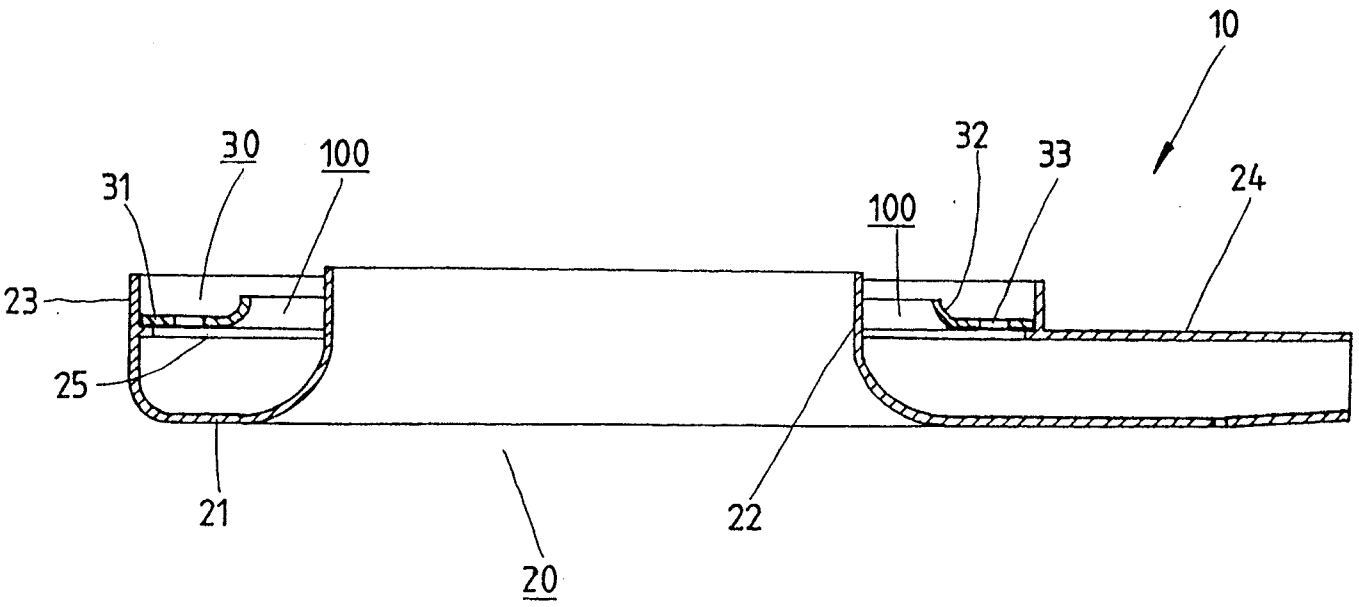
FIG. 5 shows a perspective view of the wind guiding disk in combination, according to the present invention as shown in FIG. 1.

Referring to FIGS. 1–5, a wind guiding disk 10 embodied in the present invention is shown to comprise a first element 20 and a second element 30.

The first element 20 is made of a heat-resisting plastic material by injection molding. The first element 20 has a first bottom flat collar 21, a first inner upright collar 22 extending upwards from the inner edge of the first bottom flat collar 21, and a first outer upright collar 23 extending upwards from the outer edge of the first bottom flat collar 21. The first outer upright collar 23 is provided with an opening located at the right half portion of the lower segment thereof. The first element 20 is further provided with a wind guiding tube portion 24 extending integrally and outwardly from the opening of the first outer upright collar 23. The wind guiding tube portion 24 has an outer end which remains open, a bottom plate 241 which has an outer segment warping slightly in a rightward and upward direction, and a drip hole 242 located between the flat portion of the bottom plate 241 and the starting point of the warped outer segment of the bottom plate 241. In addition, the first outer upright collar 23 is provided in the middle segment of the inner circumference thereof with a stopping collar 25 extending inwardly and horizontally.

The second element 30 is also made of the heat-resisting plastic material and composed of a second bottom flat collar 31 having a radial width smaller than the distance between the first inner upright collar 22 and the first outer upright collar 23 of the first element 20. However, the second bottom flat collar 31 has an outer diameter which is slightly smaller than the inner diameter of the first outer upright collar 23. The second element 30 is provided with a second inner upright collar 32 extending upwards along the inner edge of the second bottom flat collar 31 and having a plurality of through holes 33 which are spaced at a predetermined interval. In combination, the second element 30 is fitted into the first element 20 with an appropriate tightness such that the bottom of the outer segment of the second bottom flat collar 31 of the second element 30 is located on the top of the stopping collar 25 of the first element 20. As a result, a passage 100 is formed between the first inner upright collar 22 of the first element 20 and the second inner upright collar 32 of the second element 30.

Figure 6:
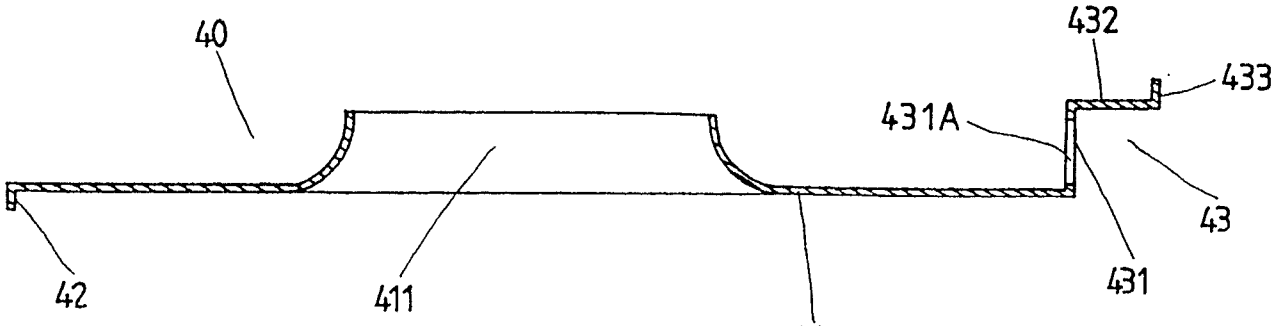
FIG. 6 is a schematic view showing that a bottom plate of a kitchen smoke exhauster is provided with the wind guiding disk of the present invention.
Figure 7:
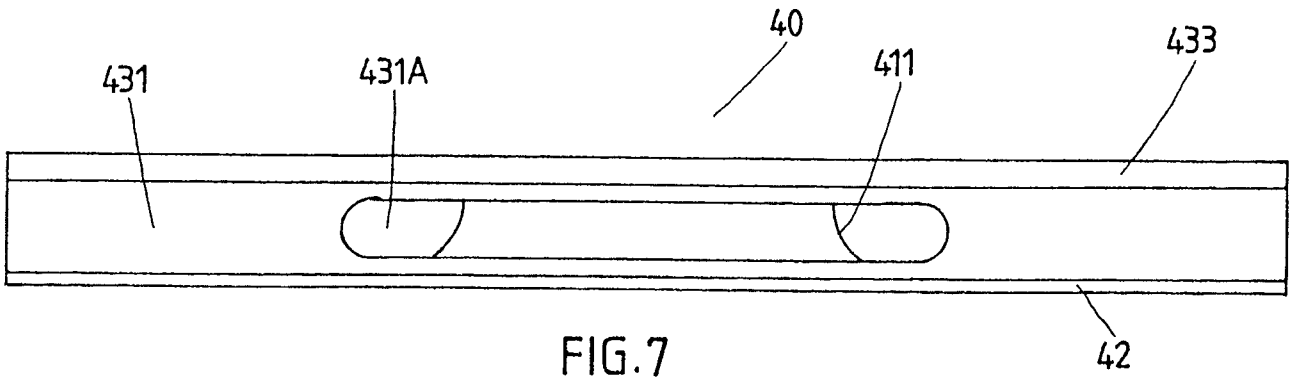
FIG. 7 shows a right elevational view of the bottom plate as shown in FIG. 6.

Before a conventional kitchen smoke exhauster is provided with the wind guiding disk 10 of the present invention, the bottom plate of the conventional kitchen smoke exhauster should be modified appropriately, as shown in FIGS. 6 and 7, in which the bottom plate 40 is shown to comprise a main plate portion 41 of square construction. The main plate portion 41 is provided with a main smoke inlet 411, a fastening portion 42 located at the front edge thereof, and a wind guiding portion 43 located at the rear edge thereof. The wind guiding portion 43 has an upright plate 431 with a bottom edge which is connected with the rear edge of the main plate portion 41. The upright plate 431 has a top edge which extends horizontally and rearwards to form a flat plate 432 having a rear edge provided with a rear fastening portion 433. In addition, the upright plate 431 is provided with an insertion hole 431A.

Figure 8:
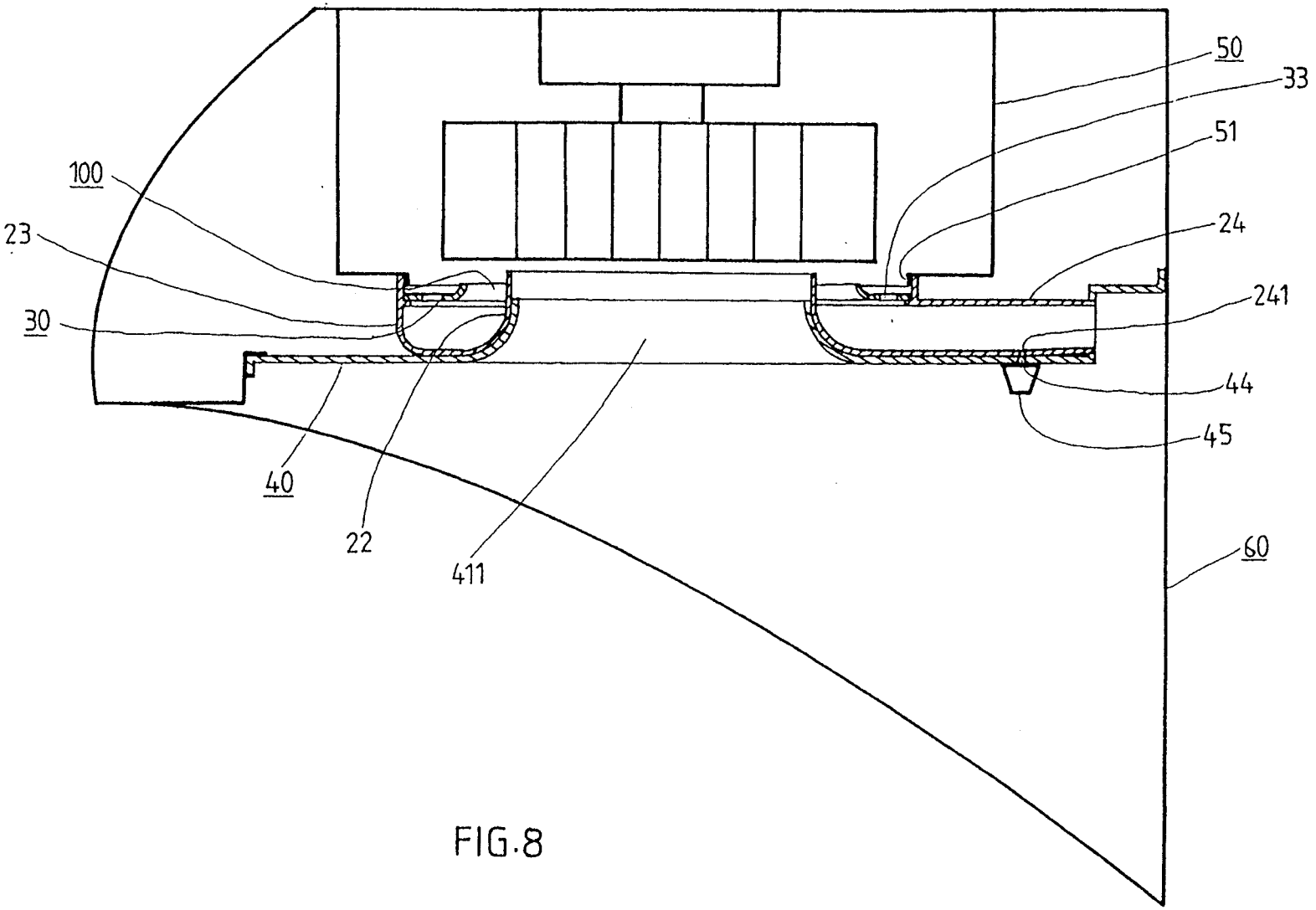
FIG. 8 is a schematic view showing that the present invention is mounted in a kitchen smoke exhauster.

The physical combination of the wind guiding disk 10 of the present invention with the conventional kitchen smoke exhauster is schematically illustrated in FIG. 8. The top edge of the outer upright collar 23 of the first element 20 of the wind guiding disk 10 is pressed against the bottom of a smoke inlet 51 of a wind box 50. In the meantime, the outer end of the wind guiding tube portion 24 of the first element 20 is inserted into the insertion hole 431A of the bottom plate 40 which is provided with a flow guiding hole 44 projecting slightly and upwardly and corresponding in location to the drip hole 242 of the first element 20. Located under the flow guiding hole 44 is an oil collecting cup 45. The fastening portion 42 of the bottom plate 40 and the rear fastening portion 433 are fastened securely and respectively to the front and the rear sides of the interior of a housing 60. In addition, the bottom plate 40 is fastened respectively at the left and the right sides thereof to the left and the right sides of the interior of the housing 60.

Figure 9:
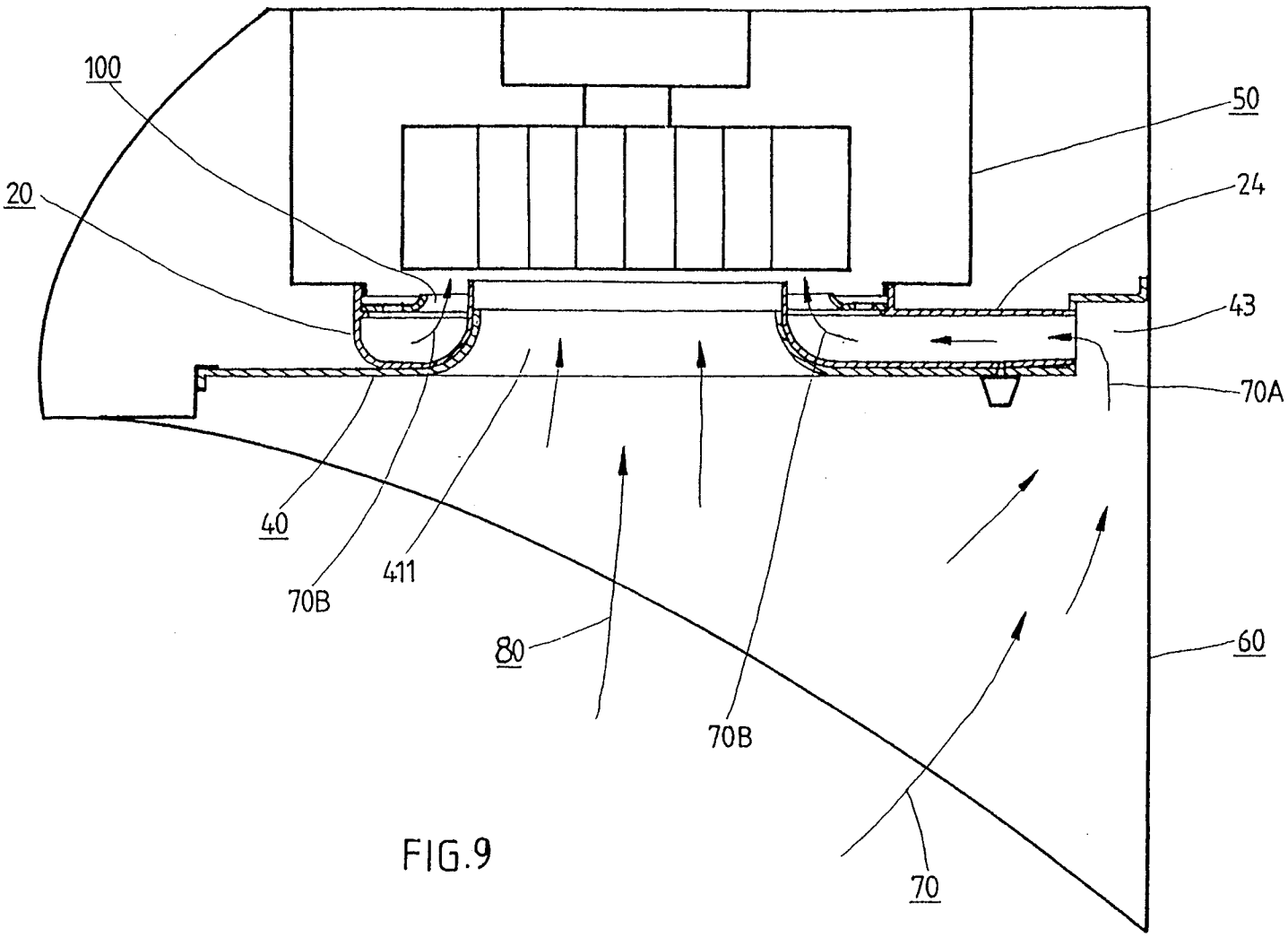
FIG. 9 is a schematic view of the present invention in action.

As shown by an arrow 80 in FIG. 9, some of the cooking fume is drawn into the main smoke inlet 411 while the rest of the cooking fume is drawn upwards, as indicated by an arrow 70, into the wind guiding portion 43 of the bottom plate 40 wherein the cooking fume is further drawn into the wind guiding portion 24 of the first element 20 from the rear end of the wind guiding portion 24, as indicated by an arrow 70A. As indicated by an arrow 70B, the cooking fume is finally drawn into the wind box 50 via the passage 100. It is therefore readily apparent that the wind guiding disk 10 of the present invention is capable of assisting the conventional kitchen smoke exhauster in exhausting the cooking fume more effectively.

Figure 10:
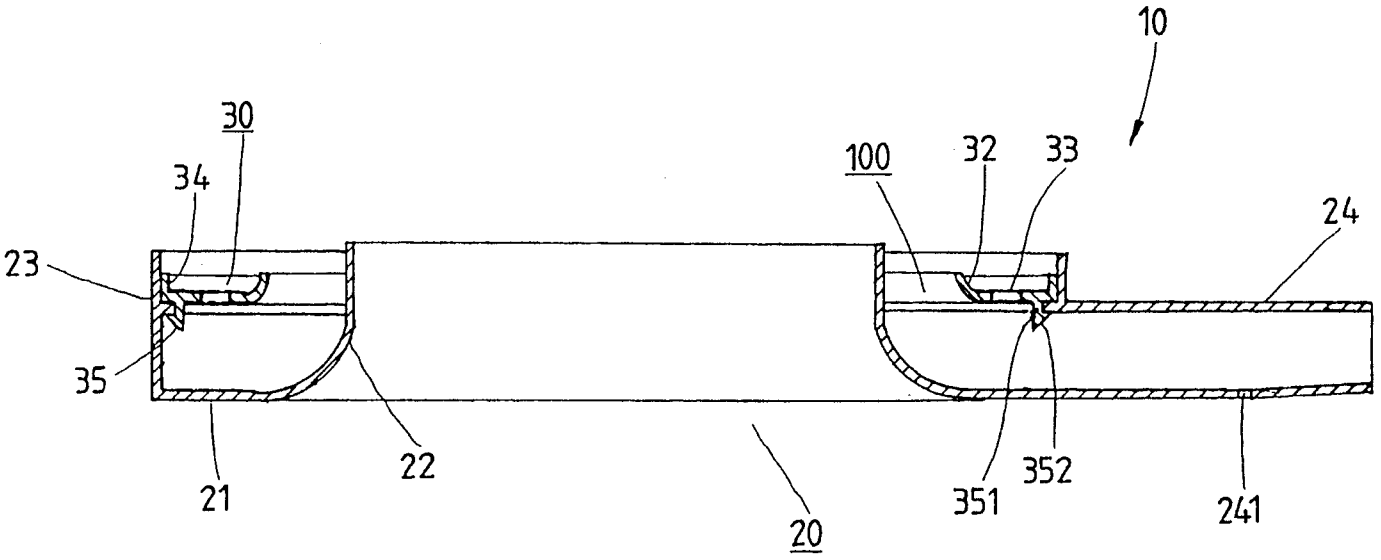
FIG. 10 shows a schematic view of another preferred embodiment of the present invention.
Figure 11:
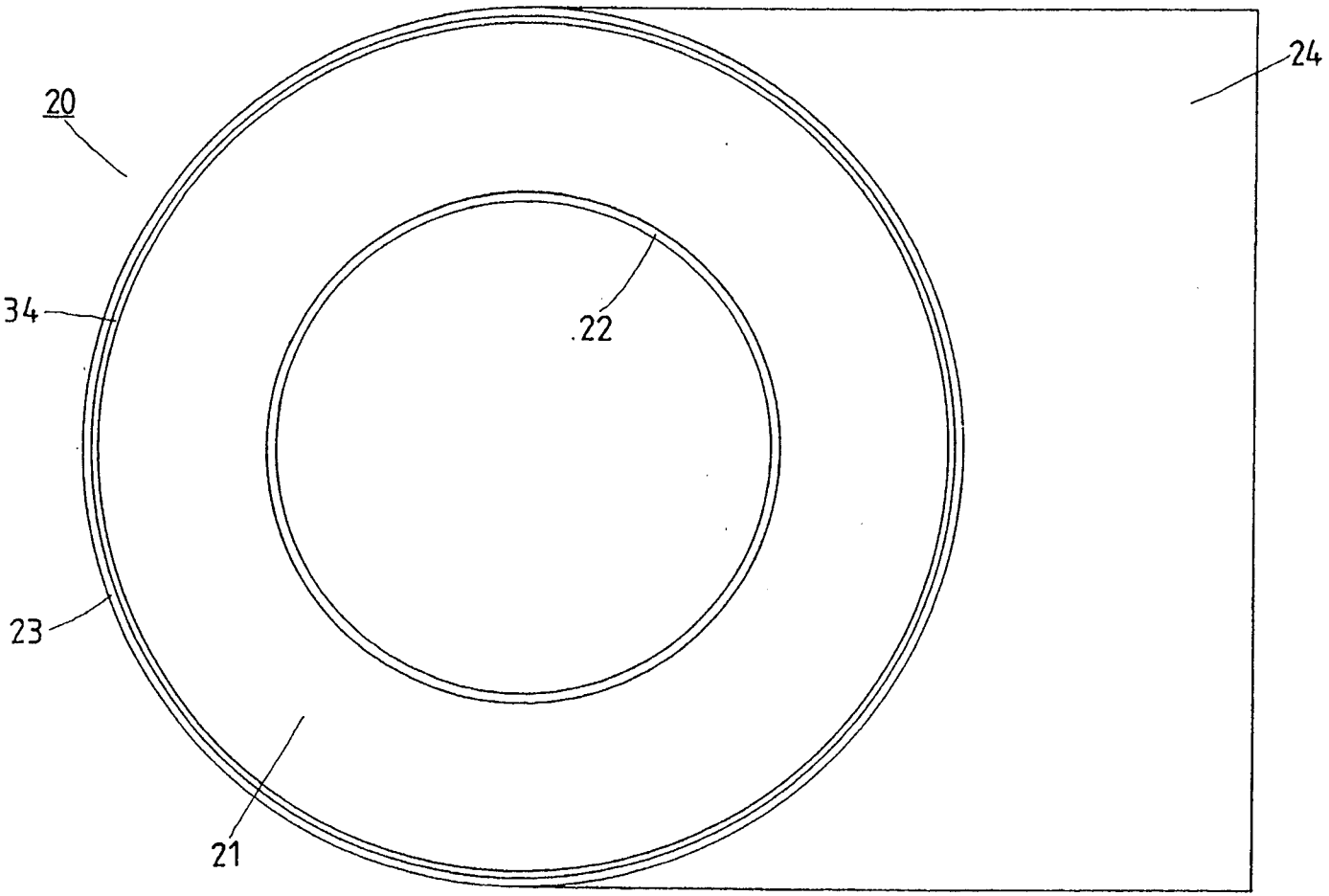
FIG. 11 is a top plan view of the preferred embodiment as shown in FIG. 10.

Another preferred embodiment of the present invention is illustrated in FIGS. 10 and 11. The second element 30 of the wind guiding disk 10 is provided with the second bottom flat collar 31, which is in turn provided with a second outer upright collar 34 extending upwards from the outer edge of the second bottom flat collar 31. The second outer upright collar 34 has an outer circumferential surface which urges the inner circumferential surface of the upper segment of the first outer upright collar 23 of the first element 20. In addition, the second bottom flat collar 31 is provided near the outer edge of the bottom thereof with a plurality of hooked portions 35 which are spaced at a predetermined interval and provided with a shaft 351 extending downwards from the bottom of the second bottom flat collar 31 and having a retaining portion 352 of an inverted triangular construction and extending outwards from the upper end of the shaft 351. The distance between the top of the retaining portion 352 and the bottom of the second bottom flat collar 31 is slightly greater than the thickness of the stopping collar 25 of the first element 20. The retaining portion 352 of the hooked portions 35 makes contact with the outer edge of the stopping collar 25 at the time when the second element 30 is pressed downwards. As the retaining portion 352 is provided with a triangular bevel, the lower segment of the hooked portions 35 can be easily caused to bend inwardly and obliquely. As soon as the bottom of the second bottom flat collar 31 is caused to make contact with the top of the stopping collar 25, the hooked portions 35 is caused to return elastically to their original position to retain the stopping collar 25. As a result, the second element 30 is located securely.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A wind guiding disk of a kitchen smoke exhauster comprising:

a first element having a first bottom flat collar which is in turn provided with a first inner upright collar extending upwards from an inner edge thereof, and with a first outer upright collar extending upwards from an outer edge thereof, said first outer upright collar having a top edge urging a circumference of a smoke inlet located at a bottom of a wind box of a kitchen smoke exhauster, said first outer upright collar further having a lower segment provided with an opening located at a predetermined position thereof, said first outer upright collar still further having a wind guiding tube portion extending outwards from said opening, with said wind guiding tube portion being inserted into an insertion hole of a bottom plate of said kitchen smoke exhauster, said first outer upright collar having an inner circumferential surface provided with a stopping collar extending inwardly from a middle segment of said inner circumferential surface; and a second element having a second bottom flat collar, which has a radial width smaller than a distance between the first inner upright collar and the first outer upright collar of the first element and which has an outer diameter slightly greater than an inner diameter of the first outer upright collar of the first element, said second bottom flat collar being provided with a second inner upright collar extending upwards from an inner edge thereof, and with a plurality of through holes spaced at a predetermined interval, said second element being disposed in said first element such that a bottom surface of an outer segment of said second bottom flat collar of said second element is located on a top surface of said stopping collar of said first element, and that a passage is formed between said first inner upright collar of said first element and said first inner upright collar of said second element.

2. A wind guiding disk according to claim 1 wherein said second bottom flat collar of said second element is provided in a bottom thereof and near an outer edge thereof with a plurality of hooked portions having a shaft extending downwards from a bottom surface of said second bottom flat collar, said shaft having a lower end extending outwards to form a retaining portion of an inverted triangular construction, with a distance between a top of said retaining portion and a bottom of said second bottom flat collar being slightly greater than a thickness of said stopping collar of said first element for retaining said stopping collar.

3. A wind guiding disk according to claim 1 wherein said second bottom flat collar of said second element is provided with a second outer upright collar extending upwards from an outer edge thereof such that an outer circumferential surface of said second outer upright collar urges an inner circumferential surface of an upper segment of said first outer upright collar of said first element.

4. A wind guiding disk according to claim 2 wherein said second bottom flat collar of said second element is provided with a second outer upright collar extending upwards from an outer edge thereof such that an outer circumferential surface of said second outer upright collar urges an inner circumferential surface of an upper segment of said first outer upright collar of said first element.

5. A wind guiding disk according to claim 1 wherein said first element and said second element are made of a heat-resisting plastic material by injection molding.

6. A wind guiding disk according to claim 2 wherein said first element and said second element are made of a heat-resisting plastic material by injection molding.

* * * * *